United States Patent [19]

Kanda et al.

[11] 4,148,588

[45] Apr. 10, 1979

[54] FORCED KNEADING MIXER

[75] Inventors: Mamoru Kanda, Kumagaya; Shousuke Ishiwata, Saitama; Masaji Horiguchi, Kumagaya; Teruo Udagawa, Saitama; Seihei Mii, Urawa, all of Japan

[73] Assignees: Chichibu Cement Kabushiki Kaisha; Daito Giken Kogyo Kabushiki Kaisha, both of Japan

[21] Appl. No.: 880,142

[22] Filed: Feb. 22, 1978

Related U.S. Application Data

[63] Continuation of Ser. No. 647,557, Jan. 8, 1976, abandoned.

[30] Foreign Application Priority Data

Apr. 7, 1975 [JP] Japan ..... 50-41174

[51] Int. Cl.[2] ..... B28C 5/32

[52] U.S. Cl. ..... 366/56; 366/276

[58] Field of Search ..... 366/54, 55, 56, 64, 366/222, 224, 225, 237, 238, 243, 276, 108

[56] References Cited

U.S. PATENT DOCUMENTS

| | | | |
|---|---|---|---|
| 1,377,255 | 5/1921 | Krycki | 259/86 |
| 2,884,232 | 4/1959 | Wilkinson | 366/56 |
| 3,062,514 | 11/1962 | Waimer | 366/56 |
| 3,109,632 | 11/1963 | Wiegel | 259/84 |
| 3,339,896 | 9/1967 | McKibben | 259/72 |

FOREIGN PATENT DOCUMENTS

| | | |
|---|---|---|
| 371012 | 2/1907 | France. |
| 405143 | 12/1909 | France. |
| 912693 | 10/1946 | France. |
| 560865 | 4/1957 | Italy. |

*Primary Examiner*—Robert W. Jenkins

*Attorney, Agent, or Firm*—Robert E. Burns; Emmanuel J. Lobato; Bruce L. Adams

[57] ABSTRACT

A forced kneading concrete mixer including a or a plurality of mixing members such as paddles or blades disposed at fixed positions within a rotating pan or cylindrical vessel. The mixing member is carried by a support which is movably mounted on a stationary member and which is subjected to a vertical oscillation having an amplitude of from 2 to 5 mm and a frequency of 3500 to 6000 cycles per minute. A fluid charge comprising ingredients to form concrete is mulled and oscillated by the cooperation of the vessel and the mixing member. When subjected to the oscillation, the individual particles of cement contained in the oscillating fluid charge are dispersed and acquire moisture on their surface. The load on the mixing member is reduced inasmuch as the consistency is increased due to a temporary tendency of the charge to fluidize.

5 Claims, 6 Drawing Figures

FORCED KNEADING MIXER

This is a continuation of application Ser. No. 647,557, filed Jan. 8, 1976, now abandoned.

The invention relates to a forced kneading mixer, and more particularly to a pan-type concrete mixer including a or a plurality of stirring or mixing members disposed at fixed positions within an annular interior space of a rotating pan.

A variety of forms of pan-type concrete mixers are known including both a rotating and a non-rotating pan. A mixer having a rotating pan or cylindrical vessel includes mixing members which may be either fixedly positioned within the pan or may be driven for rotation in the opposite direction from the pan. The latter form may include a plurality of arms radially extending from the axis of rotation of the pan and on which mixing members are carried for rotation in the opposite direction from the rotation of the pan. An alternate form is also known in which the mixing members rotate about their own axis while undergoing an epicyclic motion. The mixing members are usually known in the form of paddles or blades.

When a variety of ingredients such as cement, fine aggregate, coarse aggregate and other blending materials of different specific gravity and particle size are mixed together in the mixer of the type described, they undergo a very complex motion by the action of the mixing members. In the region of the mixing members, the ingredients are thrown both vertically and laterally, generally producing a twisting movement circumferentially of the pan. In this mode of operation, the forward edge of the mixing members functions as a knife which shears the fluid charge of the ingredients, and it is known that the members experience a severe abrasion. Another unrecognized disadvantage with this type of mixer is its failure to break a flock of cement, caused by the addition of water, into smaller pieces or particles in a perfect manner. Here, it is necessary to discern between a mere mixing which refers to a uniform dispersion of one material into the other and a kneading which refers to a uniform deposition of moisture to the surface of every particle of cement. The preparation of a desirable fresh concrete obviously requires both the mixing and the kneading process. Known mixers with mixing members achieve a forced mixing of ingredients by the members, which however only produces a kneading effect as a secondary effect, thereby leaving cement particles in a flock condition. A fresh concrete which has been sufficiently mulled improves the consistency and workability and tends to produce an increased compression strength when it is set, as compared with a mix of the same blending proportion but with less mulling effect. It is found that an increase in the duration of operation of the mixer or an increase in the rotational speed of the pan and/or mixing members does not achieve any significant improvement in the kneading effect, but merely results in a reduction in the operational efficiency and effective life of the mixer as well as an increased power dissipation.

Therefore, it is an object of the invention to overcome the above disadvantages of the conventional mixers by providing a forced kneading mixer capable of uniformly mixing and sufficiently kneading ingredients.

It is another object of the invention to provide a forced kneading mixer which completes the mulling process in a reduced time and with a reduced power than with conventional mixers.

It is a further object of the invention to provide a forced kneading mixer which substantially reduces the abrasion of mixing members.

In accordance with the invention, there is provided a forced kneading mixer comprising a rotatable, upright cylindrical pan, means for driving the pan for rotation in a given direction, a mixing member disposed within the pan, a support for carrying the mixing member, means for mounting the support in a movable manner, and mean for imparting oscillation to the mixing member substantially in vertical direction.

In a preferred embodiment of the invention, a pair of mixing members are disposed at fixed positions within the pan which are diametrically opposite to each other. The members are carried by a pair of separate supports which are firmly secured to a common oscillating table, which is in turn mounted on a stationary beam extending over the pan, with resilient spacers interposed between the table and the beam. The table carries a pair of electric motors of the same rating thereon which are adapted to rotate in the opposite directions. The shafts of the motors may be provided with unbalancing weights at their opposite ends. The motors cooperate with each other to cause an oscillation of the table in the vertical direction, which oscillation is transmitted through the supports to the individual mixing members. The oscillation may have an amplitude of 2 to 5 mm and a frequency of 3500 to 6000 cycles per minute.

In a practical embodiment, an additional pair of mixing members are carried by another pair of supports which are secured to a separate oscillating table in common in a plane offset from the first mentioned oscillating table. The both oscillating tables can be mounted in common on cruciform beams. In the same fashion, further mixing members may also be provided in pair or pairs.

With the mixer according to the invention, the ingredients are uniformly mixed together by the shearing and throwing action of the mixing members, and are also subjected to the oscillation imparted by the mixing members, which achieves a good kneading effect. It is found that the direct application of oscillation to the ingredients from the mixing members results in a good dispersion of ingredients, in particular, cement particles, which acquire a uniform deposition of moisture on their surface, thereby nearly completely breaking the flocks of the cement. It is also found that the fluid charge comprising these ingredients exhibits an increased consistency as a result of a temporary tendency of the charge to fluidize when undergoing the influence of the oscillation. This effect is advantages in reducing the effect of impact upon the mixing members caused by the fluid charge as it is sheared by the mixing members, and thus facilitating the shearing and throwing action of the latter. This reduces the load on and the abrasion of the mixing members. The reduced load permits a reduction in the power which must be supplied to the rotating pan to convey the ingredients into engagement with the mixing members. The smooth shearing and throwing action of the mixing members also reduces the friction between the charge and the pan and hence the abrasion of the internal lining of the pan.

The above and other objects, features and advantages of the invention will become apparent from the following detailed description of an embodiment thereof with reference to the drawings, in which.

FIGS. 3 to 6 graphically show various properties of concrete samples obtained with the mixer of the invention in comparison with corresponding results obtained with a conventional mixer.

Figure 1:
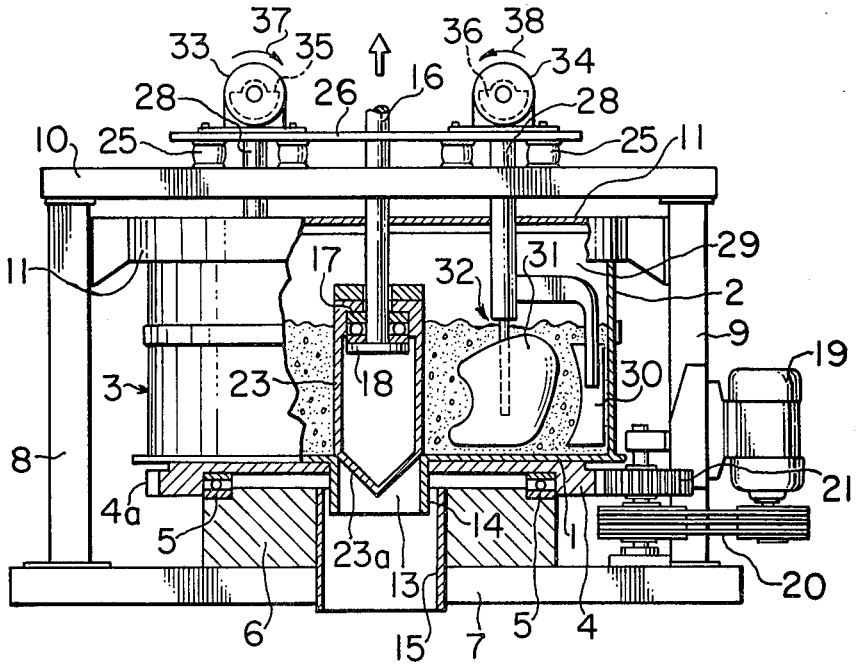
FIG. 1 is a side elevation, partly broken away of the mixer according to the invention.
Figure 2:
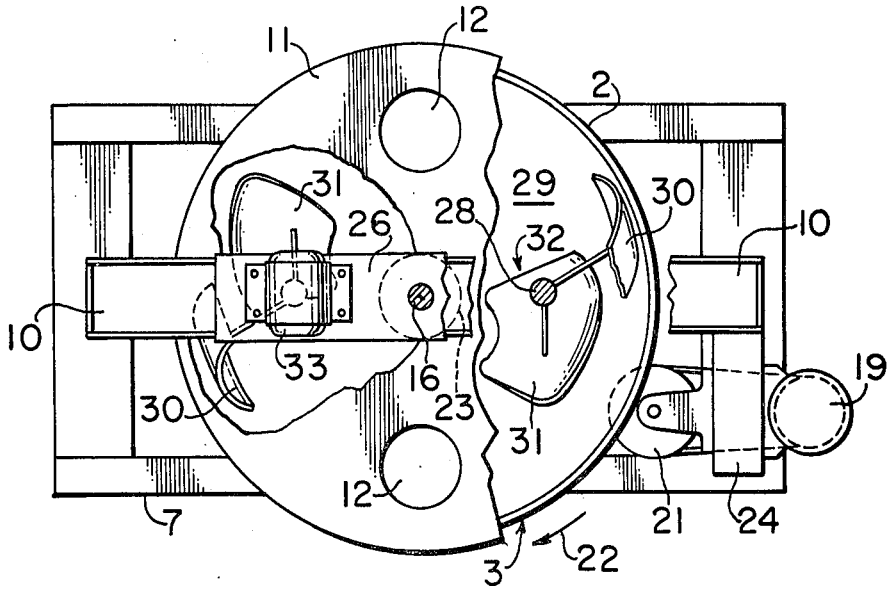
FIG. 2 is a top view, partly broken away of the mixer shown in FIG. 1.

Referring to the drawings, there is shown a mixer according to the invention which includes a cylindrical pan 3 having a bottom 1 and a sidewall 2. The pan 3 is firmly mounted on the upper major surface of a driven gear 4 of substantially an equal diameter, which is in turn rotatably mounted on a boss 6 with a thrust bearing 5 interposed therebetween. The boss 6 is fixedly mounted on a base 7, which fixedly carries a pair of spaced posts 8, 9 of a substantial thickness, and a beam 10 having a substantial width extends between the top ends of the posts 8, 9. A stationary cover 11 is located intermediate the posts 8, 9 and is closely spaced from the pan for closing the top opening of the pan 3. The cover 11 is formed with a pair of inlets 12 (see FIG. 2) through which ingredient materials are supplied. The bottom 1 is centrally formed with an exhaust outlet 13, which is normally closed by a value body 23*a* of a liftable cylinder 23. The outlet 13 defines a chute 14 which communicates with another chute 15 extending through the boss 6. A lifting rod 16 extends into the cylinder 23, and has a flange 18 at its lower end which is operatively connected with the cylinder through a thrust bearing 17. The lifting rod 16 extends through the cover 11 and the beam 10 for connection with a suitable lifting device, not shown. The driven gear 4 has a toothed portion 4*a* which meshes with a drive gear 21 which is in turn drivingly connected with the shaft of an electric motor 19 through a belt 20 running therebetween. As the motor 19 is set in motion, the pan 3 is driven for rotation in a direction indicated by an arrow 22 (FIG. 2). It will be noted that the motor 19 and the gear 21 are mounted on a board 24 which is secured to the post 9.

An oscillating table 26 is mounted on the beam 10 with resilient spacers 25 interposed therebetween, and a pair of rigid supports 28 which extend through the cover 11 and the beam 10 have their top end firmly secured to the table 26. The supports 28 extend into the pan 3 and are located opposite to each other diametrically thereof so that the other end of each support terminates centrally within the annular space of the pan 3. A pair of blades 30, 31 which form together a mixing member 32 are secured to the lower end of each support 28 and are disposed in an offset manner from each other. One of the blades, 30, is located at a slightly advanced position relative to the other blade 31, as viewed in the direction of rotation of the pan 3, and serves to dip up the ingredient materials toward the center of the pan 3 as they travel along the sidewall 2 thereof. The other blade 31 functions to scoop the ingredient materials which travel around the cylinder 23 toward the sidewall 2. In this manner, the pair of blades 30, 31 cooperate with each other to induce a compound motion in the ingredient materials for the purpose of a uniform mixing. While the mixing member 32 shown has a practical form, it is to be understood that the invention is not limited to the exact form of the mixing member shown, but is also operable with other forms of blades and paddles.

In accordance with the invention, a pair of electric motors 33, 34 are mounted on the oscillating table 26 which is common to the both supports 28. Each of the motors has an axis of rotation which is disposed in a common horizontal plane and which lies in a vertical plane intersecting at right angles with a vertical plane which includes the both axes of individual supports 28 and having an equal spacing from the axis of rotation of the pan 3. Preferably, the axis of each motor shaft intersects with the axis of the support 28 at right angles thereto. The shafts of the both motors 33, 34 are provided with unbalancing weights 35, 36 at their opposite ends, the weights being mounted at an equal angular position on the both motor shafts. During rotation of the motors, these weights cause a vertical oscillation of the table 26. In order to cancel out oscillation components of the table 26 which occur in different directions it is preferred to employ a pair of motors having the same rating and to rotate them in opposite directions from each other, as shown by arrows 37, 38. The oscillation in the vertical direction may have an amplitude of 2 to 5 mm and a frequency of 3500 to 6000 cycles perminute. Such oscillation of the table 26 is transmitted through the supports 28 to the mixing members 32, which cause adjacently located cement particles to be dispersed and their surface wetted with water. The dispersion and wetting of the cement particles are promoted by the simultaneous shearing and throwing action of the mixing members.

The amount of ingredient materials which is driven toward the mixing members 32 will produce a bending moment on the supports 28, which however is less than expected since in the region of the mixing members 32, the fluid charge comprising the ingredient materials exhibits an increased consistency as a result of a temporary tendency to fluidize and since the bending moment applied to the mixing members will be only caused by a component of the motion of the charge as it is scooped or dip up by the blades. Therefore, it is a relatively simple matter to afford a sufficient strength to the supports 28 to resist such bending moment, by merely securing their top end firmly to the oscillating table 26. One consideration to be paid in this connection is the resistance presented by the spacers 25 which support the table 26 in a floating manner. If the resistance of the spacers is excessively low, there results a tilting of the table 26. In order to avoid this, the spacers may each comprise a rubber sleeve with a coiled spring fitted therein.

A fresh concrete obtained with the mixer of the invention has an excellent consistency and workability since the ingredients are uniformly mixed and the flock of cement is almost completely broken into smaller particles. The value of the concrete product obtained is increased because it is free from any residue or cement which remains in powder form. The mixing process is completed within a reduced time period and with a reduced power requirement, greatly improving the operating efficiency and reducing the abrasion or damage of the mixer.

Referring to FIGS. 3 to 6, which graphically show various properties of the concrete samples obtained with the mixer of the invention in comparision with those obtained with a conventional mixer having a rotating pan with mixing members which undergo a satellitic motion. Curves designated A represents the response of a sample obtained with the mixer of the invention while curves designated B represent the response of a sample obtained with the conventional mixer. The mixers used for the comparison purpose have a capacity of 20 liters per batch. To prepare the sample, normal Portland cement is used together with gravel having a specific gravity of 2.64 as coarse aggregate and with sand having a specific gravity of 2.63 as fine aggregate. The mixing process is conducted for the same period, using the same proportion of materials for the samples A and B.

Figure 3:
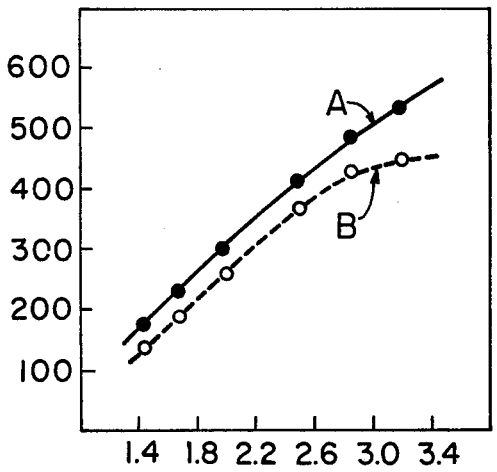

FIG. 3 shows the compression strength versus cement/water ratio of a set concrete which is most significantly influenced by the kneading performance. The ordinate represents the compression strength in $kg/cm^2$ while the abscissa represents the cement/water ratio. The sample formed is a solid cylinder having a height which is twice as high as its diameter. The maximum dimension of the coarse aggregate used is 10 mm, and the mulling process is continued for a three minute period. The preparation of sample, curing, age and testing procedure conform to the standards known as JIS (Japanese Industrial Standards) A-1132 and A-1108, and the same applies also to those samples which will be described later in connection with other Figures. As will be evident from FIG. 3, the sample produced with the mixer of invention has a compression strength which is by 10 to 15% improved over that of a sample produced with the conventional mixer.

Figure 4:
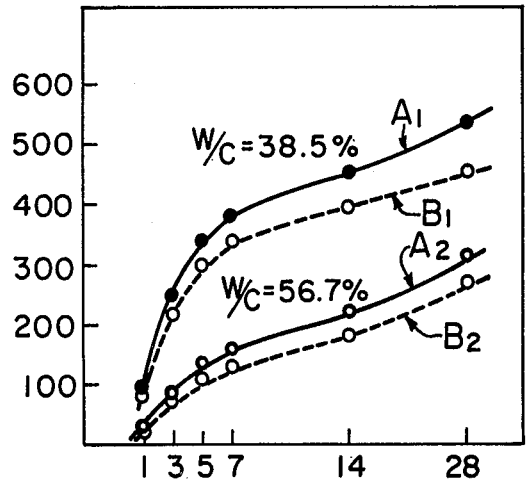

FIG. 4 shows the compression strength (in $kg/cm^2$) plotted against the age of the concrete being set, which is indicated on the abscissa in terms of days. The maximum dimension of coarse aggregate used in the sample is 25 mm. Curves A1 and B1 represent the response when an air entraining agent is added (water/cement ratio of 38.5%), while curves A2 and B2 represent the response when an dispersing agent or water reducing admixture is added (water/cement ratio of 56.7%). FIG. 4 again indicates the excellent mulling effect achieved with the invention over the prior art.

Figure 5:
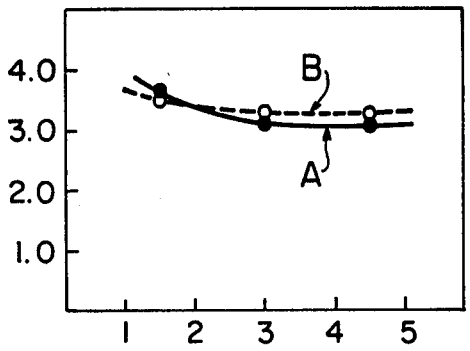

FIG. 5 shows the air content in percentage on the ordinate plotted against the mulling time in minutes indicated on the abscissa. The test relied on the air pressure injection by Washington-type air meter. While it may appear that the air content will be reduced in the sample obtained with the mixer of the invention because of the applied oscillation. FIG. 5 clearly indicates that an air content comparable to that of a sample produced with the conventional mixer is maintained.

Figure 6:
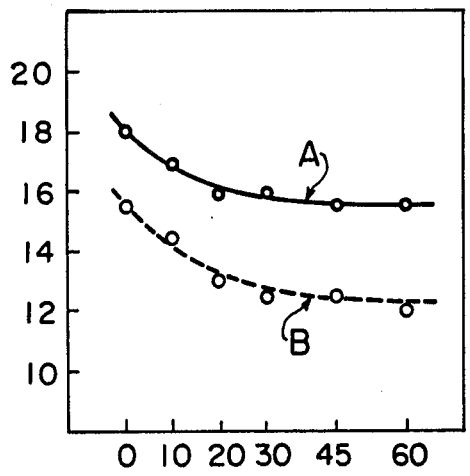

FIG. 6 shows a slump test of a concrete sample being set. The ordinate represents the slump in centimeters and the abscissa the time in minutes. This indicates the degree of deformation of a concrete sample under the influence of gravity after a slump cone is removed. The sample obtained in accordance with the invention exhibits a slump value which is substantially higher than that of a sample obtained according to the prior art, indicating an improvement in the consistency and the plasticity.

While the invention has been illustrated and described above with reference to a particular embodiment and particular examples, it should be understood that certain changes and modifications can be made therein without departing from the spirit and scope of the invention, which is solely limited by the appended claims.

Having described the invention, what is claimed is:

1. A forced kneading mixer comprising a rotatable, upright cylindrical pan, means for driving the pan for rotation in a given direction, a mixing member disposed within the pan, a support for carrying the mixing member, means for mounting the support in a movable manner, means for imparting oscillation to the mixing member, said mounting means comprising a stationary member, and an oscillating table movably mounted on the stationary member with interconnecting means, means interposed therebetween, said support being secured to the oscillating table, and said means for imparting oscillation comprising an electric motor fixed mounted on the oscillating table and adapted to develop oscillation.

2. A forced kneading mixer comprising a rotatable, upright cylindrical pan, means for driving the pan for rotation in a given direction, a mixing member disposed within the pan, a support for carrying the mixing member, means for mounting the support in a movable manner, means for imparting oscillation to the mixing member, another mixing member disposed within the pan at a position diametrically opposite to the first mentioned mixing member, and another support for carrying said another mixing member and movably mounted on the mounting means, said mounting means comprising a stationary beam extending over the pan, and an oscillating table movably mounted on the beam with resilient spacer means interposed therebetween, means for securing both of said supports being secured to the oscillating table in common, and said means for imparting oscillation being mounted on the oscillating table and imparting oscillation to both said mixing members through the supports.

3. A forced kneading concrete mixer according to claim 2, in which both of said supports have an axis which is parallel to and located on diametrically opposite sides of the axis of rotation of the pan, and in which said means for imparting oscillation comprises a pair of electric motors having axes of rotation which lie in a common horizontal plane and which lie in a vertical plane intersecting at right angles with a vertical plane which includes both axes of the individual supports and having an equal spacing from the axis of rotation of the pan.

4. A forced kneading concrete mixer according to claim 3 in which the pair of motors are of an equal rating and driven for rotation in opposite directions to each other.

5. A forced kneading mixer according to claim 1, in which said means for imparting oscillation imparts oscillations to the mixing member having an amplitude of 2 to 5 mm. in the vertical direction and a frequency of 3500 to 6000 cycles per minute.

* * * * *